US005701839A

United States Patent [19]

Jasper

[11] Patent Number: 5,701,839

[45] Date of Patent: Dec. 30, 1997

[54] PRESSURE MINESWEEPING VEHICLE

[75] Inventor: Norman H. Jasper, Panama City, Fla.

[73] Assignee: The United States of America as represented by the Secretary of the Navy, Washington, D.C.

[21] Appl. No.: 619,116

[22] Filed: Feb. 21, 1967

[51] Int. Cl.[6] ..... B63B 1/38

[52] U.S. Cl. ..... 114/264; 114/67 A

[58] Field of Search ..... 114/221, 235, 114/264, 67 R, 67 A, 125; 180/125, 127, 128

[56] References Cited

U.S. PATENT DOCUMENTS

| | | | |
|---|---|---|---|
| 3,012,534 | 12/1961 | Thomas | 114/235 |
| 3,078,938 | 2/1963 | Bollum, Sr. | 114/125 X |
| 3,205,847 | 9/1965 | Smith | 114/67.1 |
| 3,285,356 | 11/1966 | Cockerell | 180/127 |
| 3,319,592 | 5/1967 | Hunt | 114/67.1 |
| 3,330,369 | 7/1967 | Hayward | 180/127 |

*Primary Examiner*—Michael J. Carone
*Attorney, Agent, or Firm*—Harvey A. Gilbert; William C. Townsend

[57] ABSTRACT

A marine pressure minesweeping and ship signature simulating vehicle having an inflated substantially doughnut shaped tubular float surrounding a pressurized air-filled cavity. The lower part of said float rides on the surface of the water and the upper part thereof is closed with a resilient membrane, upon the upper side of which is mounted water ballast container means, which is sufficiently open at the top to allow the water ballast to be ejected therefrom, as a result of a considerable increase in air pressure occurring in the aforesaid air filled cavity, due to a mine explosion. A motor driven fan maintains a suitable air pressure in said air-filled cavity at substantially all times, and drive and steering means are mounted on the vehicle in such manner as to enable it to be navigated along a desired course. The length of ship simulation pressure signatures may be varied by varying the number of vehicles connected in tandem, and the amount of water ballast employed may be varied according to the tonage of the ship being simulated at any given time.

11 Claims, 3 Drawing Sheets

11
12
13
15
16
18
19
21
23
25
26
27
28
29
30
32
33
34
35
36
37
38
39
41
42
43
44
45
46

12
13
19
21
22
23
25
27
28
30
32
35
41
42

PRESSURE MINESWEEPING VEHICLE

The invention described herein may be manufactured and used by or for the Government of the United States of America for governmental purposes without the payment of any royalties thereon or therefor.

The present invention relates generally to minesweeping vehicles, and, in particular, it is a marine vehicle for sweeping submarine or bottom influence mines which are detonated in response to the water pressure patterns made by a ship, as it travels along its course. In even greater particularity, it is a method and means for generating a captive air-filled cavity projecting into the water through the upper surface thereof, which simulates the water pressure signature of various and sundry moving ships and, accordingly, may be used for the destruction of sea mines that are responsive thereto, without being destroyed thereby.

Pressure responsive sea mines ordinarily have incorporated therein an actuating mechanism which is so constructed and programmed as to respond to several concomitantly or consecutively occurring conditions, viz., a predetermined increase and/or reduction in the pressure of the water ambient to the mine, and an increase and/or reduction in said water pressure for given intervals of time. Typically, suck pressure mines contain a detonator operatively connected to a firing circuit which is closed or completed when a reduction in the ambient water pressure has been continually maintained for a predetermined period of time. The time element is, of course, of paramount importance with respect to pressure responsive mines, because it is usually the parameter which prevents premature detonation thereof, as a result of wave action, the occurrence of tides and seiches, or any other spurious environmental conditions.

In the past, numerous methods and means have been employed for the purpose of sweeping and destroying or neutralizing pressure responsive mines. For some purposes during some particular operational situations, the devices of the prior art have been fairly satisfactory; however, for the most part, end for the purpose of minesweeping in general, they leave a great deal to be desired.

One previous method, for example, of creating the water pressure signature for sweeping a pressure responsive mine was to sail an expendable ship through the mine field. The obvious disadvantage of this method is that ordinarily said ship was destroyed or disabled by the first mine detonated thereby, and, thus, the amount of sweeping accomplished by any of such ships was definitely limited and quite expensive.

Another method previously used for sweeping marine pressure mines was to tow an object or objects approaching the dimensions of a ship through the mine field. The objects used in such instances might have taken the form of a ponderous mass of water disposed within an elongated flexible envelope, or perhaps one or more float supported hydrofoils towed under water at a negative angle of attack, which caused a pressure reduction to occur on the ocean floor and, hence, in the ambient subaqueous environment of any sea mine laying thereon.

Still another method previously used without a great deal of success was the towing of ship-like vehicles that were constructed in such manner that they were virtually indestructible by reason of their great strength, bulk, construction materials, and flexibility.

All of the foregoing, as previously suggested, were operative to some extent, but they were either ineffective, severely limited, short-lived, awkward, required great propulsion power, lacked maneuverability, were exceedingly difficult and expensive to construct, or were practically impossible to transport to the mine field needing sweeping within a reasonable period of time.

Relatively speaking, the subject invention overcomes many of the disadvantages encountered in the devices of the prior art because its physical structure is, for the most part, of such construction as to make it more easily assembled and operated and more effective in its minesweeping operations.

It is, therefore, a primary object of this invention to provide an improved method and means for sweeping pressure responsive marine mines.

Another object of this invention is to provide a minesweeper that is capable of sweeping marine mines which are programmed to be detonated in response to various and sundry ambient pressure patterns.

Still another object of this invention is to provide an improved minesweeper that is capable of simulating the water pressure signatures of numerous ships and other marine vehicles, as it travels along a minesweeping course.

A further object of this invention is to provide a pressure mine sweeper which can be adjusted, changed, or controlled while in use, so as to simulate selectively the pressure signature of ships of different size and structural configuration.

A further object of this invention is to provide an improved method and means for producing large ship pressure signatures with a device that is relatively smaller and more damage resistant than the ships whose signatures are being simulated.

Another object of this invention is to provide an improved minesweeper that is considerably less vulnerable to the explosion of a mine being swept thereby.

Another object of this invention is to provide a marine minesweeper that requires less power to operate than a comparable minesweeping ship.

Still another object of this invention is to provide a minesweeper that is maneuvered more easily.

Still another object of this invention is to provide an improved minesweeper that is portable and readily assembled and disassembled at the location where it is to be used.

Another object of this invention is to provide a more effective pressure mine sweeper that is comparatively easy and economical to manufacture, operate, and maintain.

Another object of this invention is to provide an improved method and means for generating a predetermined pressure on the surface of a body of water, within said body of water, and at the floor-water interface of said body of water.

Other objects and many of the attendant advantages will be readily appreciated as the subject invention becomes better understood by reference to the following detailed description, when considered in conjunction with the accompanying drawings wherein.

Figure 1:
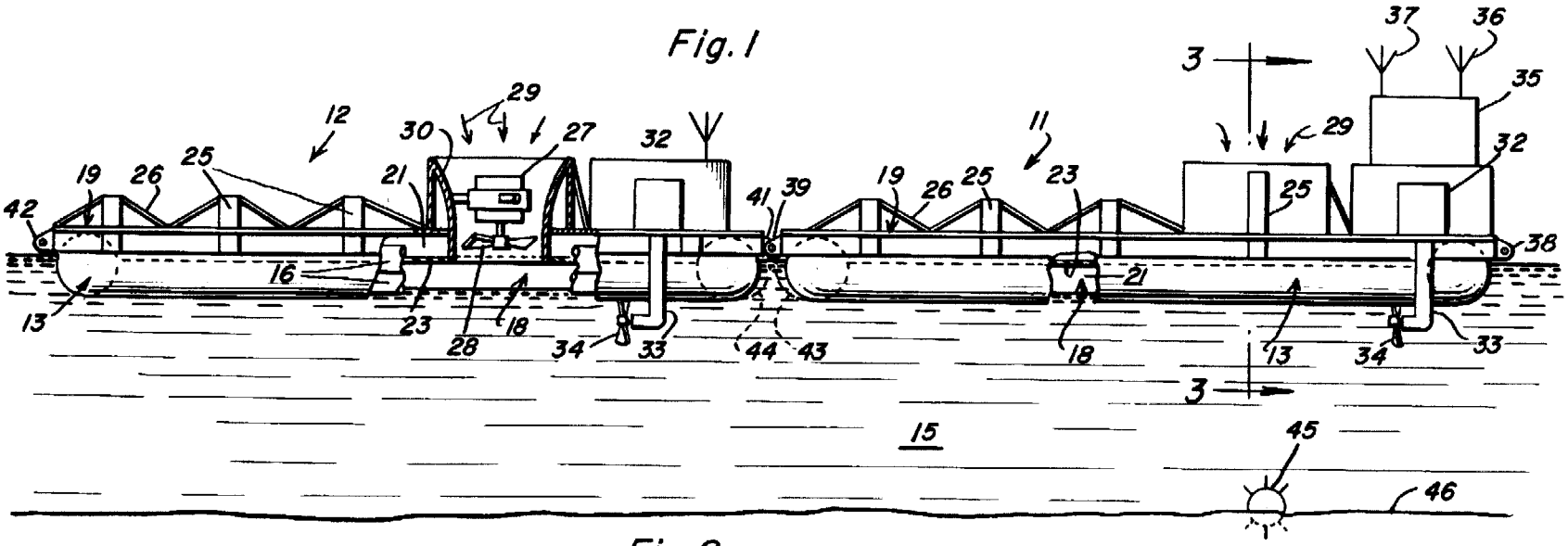
FIG. 1 is a diagrammatical mechanical representation of the side view of a preferred embodiment of the subject invention, with some of the parts thereof illustrated quasi-pictorially, and with other parts thereof depicted in schematic cross-section.

Referring now to FIG. 1, there is disclosed an embodiment of the subject invention that contains a tractor captive air bubble vehicle 11 which is towing in tandem therewith a single trailing captive air bubble vehicle 12. Although only two vehicles are depicted in this figure, it should be understood that any number of tractor and/or trailer captive air bubble vehicles may be employed, which would satisfy the mine sweeping requirements that may exist during any particular tactical maneuver. Hence, for example, if desired, only a single tractor vehicle may be used, or a single tractor vehicle and several towed vehicles may be used, as the operational circumstances warrant.

Figure 2:
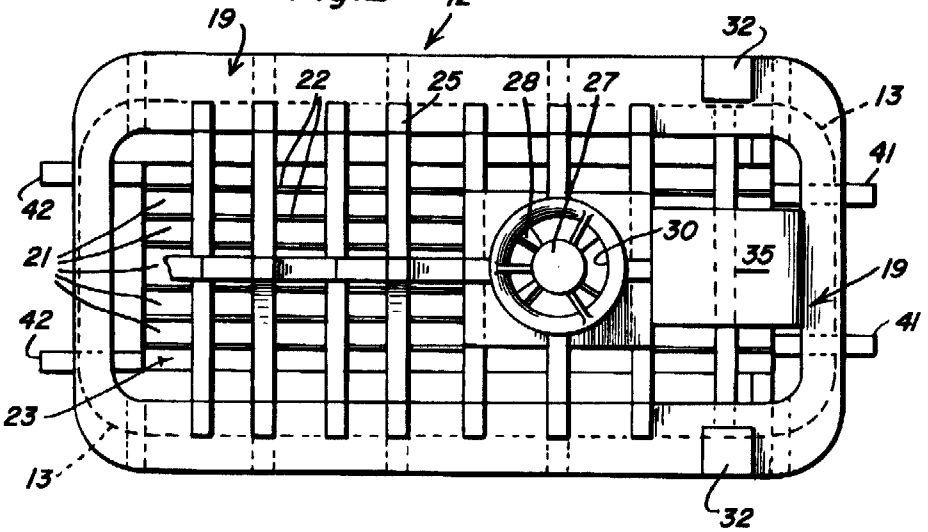
FIG. 2 is a representative top structural view of the subject invention.
Figure 3:
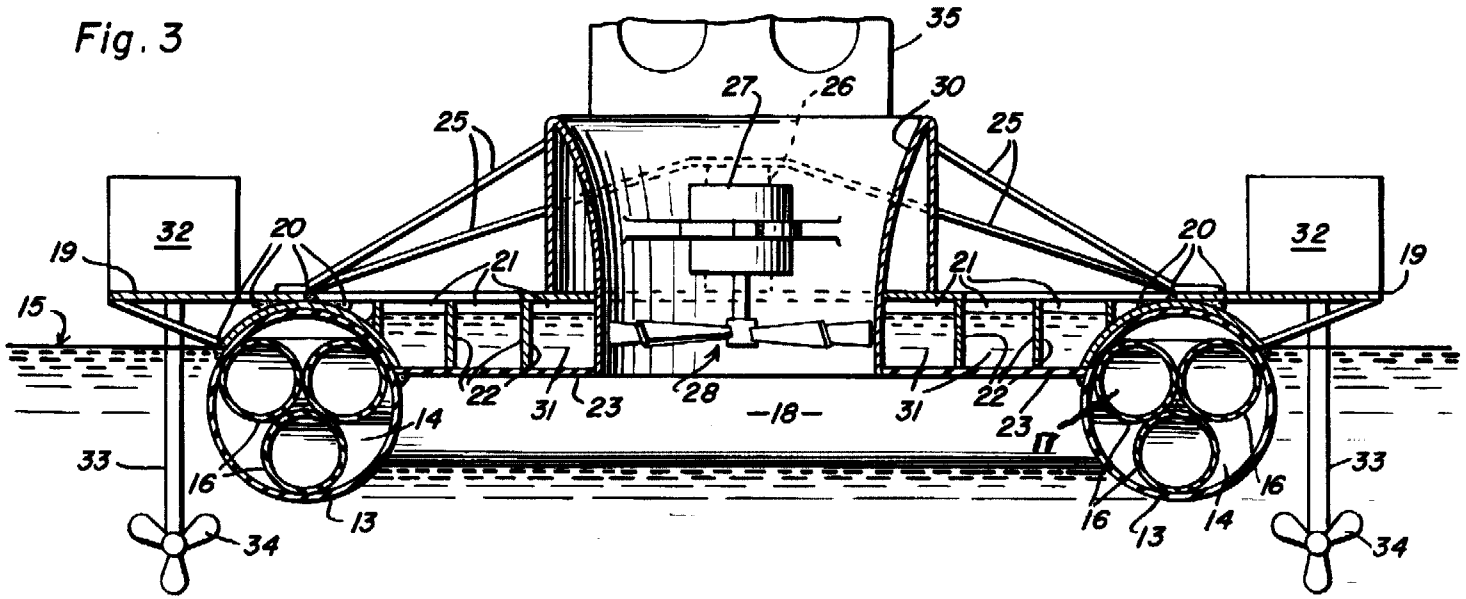
FIG. 3 is a diagrammatical structural view taken at 3—3 of FIG. 1.

As seen in FIGS. 1, 2, and 3, tractor captive air bubble mine sweeping vehicle 11 contains a resilient outer tube 13 of predetermined geometrical cross-sectional configuration and made of rubber or the like, which when inflated with air 14 at a pressure of the order of seven pounds per square inch, extends around the entire vehicle in such manner as to cause it to float on sea water 15. Inserted within inflated tube 13 is a plurality of smaller resilient rubber tubes 16, each of which when inflated with air 17 at a pressure of the order of nine pounds per square inch, likewise extends around the entire vehicle in such manner as to cause it to float in the event tube 13 is ruptured for some reason or another. Of course, in the particular preferred embodiment herewith being described, only three of such tubes 16 are used, but it should be understood that this invention should not be limited thereto, inasmuch as the number thereof is merely a matter of design choice, the selection of which is well within the purview of one skilled in the art having the benefit of the teachings herewith presented.

Not only does inflated tubes 13 and 16 cause vehicle 11 to float on the water, it enables it to do so in such manner that a large bubble of air 18 is held captive by the inner periphery of the tube assembly, as will be discussed in more detail subsequently.

Mounted on the top of the aforementioned large tube 13 is a somewhat flexible, but exceedingly strong truss-like bed or chassis 19 made of metal, wood, fiberglass, or the like. Any suitable, conventional attachment means may be used for securing bed 19 to tube 13. For example, a cement 20 may be used for this purpose, if so desired. Incorporated in truss-like chassis 19 is a plurality of open cells 21, the side walls 22 of which are preferably metallic and attached at the top thereof to chassis 19, as by welding, bolting, riveting, or any other suitable method. However, because it is usually preferable that this invention be as portable and versatile as possible, it should be understood that the various attachment means should be conventional and such as would facilitate: (1) the transporting of it to the site where it is to be used, (2) the assembly and disassembly thereof at the site where it is to be used, and (3) the repair thereof, without adversely affecting its strength, geometrical, or operational characteristics. Moreover, such construction methods should preferably be designed therein as would enable the entire vehicle to be prefabricated in sections or units that, in turn, would allow them to easily be carried aboard ship and would also optimize the construction or assembly time therefor, regardless of the physical, tactical, or personnel handicaps under which such transportation, construction, or assembly must be effected.

The underside of chassis 19 has attached thereto a resilient membrane, such as, for example, a rubber or rubberized fabric sheet 23, that is mounted on the bottom of walls 22 of cells 21 and extends substantially horizontally between and attached to the inner peripheral surface of the aforesaid tube 13, thereby forming a chamber suitable for holding a large air bubble substantially captive, when the entire vehicle is floating on the water.

Because chassis 19 may be long compared to its depth, because it may have to withstand tremendous pressures or other stresses, it preferably has bracing girders 25 and support members 26 attached thereto in such manner that its strength will be sufficient and, yet, its flexibility will not be unduly impaired, Thus, it will give and bend within its elastic limit, rather than break suddenly, should a mine explode in its proximity or should a large and powerful ocean wave strike it from any angle.

Mounted on top of chassis 19 is a housed engine or motor 27, which drives by means of its shaft a multi-bladed fan 28. As may be seen from FIG. 1, fan 28 is mounted and rotated in such manner that it blows large quantities of air 29 in a downwardly direction through one or more passageways 30 located in housed motor 27. Not being able to escape during normal operation, this air fills the chamber under vehicle 11 and assists in the support thereof, along with the aforementioned tubes 13 and 16. This large volume of air then becomes what is herein defined as a captive air bubble. The pressure thereof is determined by the speed and power at which fan 28 is driven by motor 27; however, it has been ascertained that a pressure of the order of five pounds per square inch maintains the entire vehicle at the proper level in the water for most ballasts and/or vehicle weights.

Any appropriate ballast, such as sea water 31, is disposed in proper amounts in each of cells 21. Of course, since cells 21 are completely open at the top, said ballast water may be readily poured or pumped in or out thereof in any convenient conventional manner.

The propulsion system may be of any suitable conventional type. However, it has been determined that an appropriate number of rotatable diesel engine units 32 having drive shafts 33 extending down into the water with screws or propellers 34 attached thereto through appropriate gearing (not shown) operates satisfactorily for this purpose. Although only one such engine units can be seen in FIG. 1, another thereof may also be mounted on the other side, if desired, as is shown in FIGS. 2 and 3. Likewise, additional units may be mounted at the other ends and in between, if necessary, without violating the scope of this invention. Of course, the number and power thereof should be such as would enable the captive air bubble vehicles to be driven at whatever maximum speed is required.

As will be discussed in greater detail below in connection with the system of FIG. 4, said motors are controlled, as far as rotational direction, power, and speed is concerned, by servo mechanisms, which, in turn, are manually, cable, or radio controlled. Hence, the entire tractor vehicle may be steered along any desired course through a mine field.

Mounted on top of chassis 19 is a pilot house 35, which contains all manual and/or radio controls, instruments, and the like, (not shown) necessary for the proper regulation of compressor fan 28 and propellers 34. Antennas 36 and 37 are, of course, parts of said radio controls.

Latch mechanisms 38, 39, 41 and 42 are preferably respectively mounted on both ends of both captive air bubble vehicles 11 and 12, and they should be so designed that the latch of the front of one is complementary with that of the rear of the other. Thus, vehicle 11 is capable of towing vehicle 12, in event it has no propulsion system.

In the embodiment of FIG. 1, vehicles 11 and 12 are similar, except for the size of the pilot house, which has been shown as being lower for in vehicle 12 improved visibility purposes. Accordingly, for the sake of simplicity of disclosure, some of the various individual elements of both vehicles 11 and 12 are not described in detail. Suffice it to say that vehicle 12 is the trailing vehicle and may be designed to be identical to tractor vehicle 11. On the other hand, it may be revised, designed, and structurally simplified if desired, so as not to include a supply of its own or a propulsion or steering system either, for that matter, and thereby be completely dependent on tractor vehicle 11 for such things.

As previously suggested, tubes 13 and 16 need not be uniform in size or shape. For example, if a discontinuity in pressure at the water surface between vehicles should produce an improper or inoperative water pressure signature (and thereby cause submarine pressure or bottom influence mines not to be responsive thereto), said tubes may be varied in shape between connecting vehicles, so as to contact each other thereat, as is illustrated in FIG. 1 by extended dotted line profiles 43 and 44.

In FIG. 1, the cascade connected captive air bubble vehicles are shown as traveling from left to right. Hence, the front end of vehicle 11 is seen as having just passed over a water pressure responsive mine 45 that is laying on sea floor 46.

Figure 4:
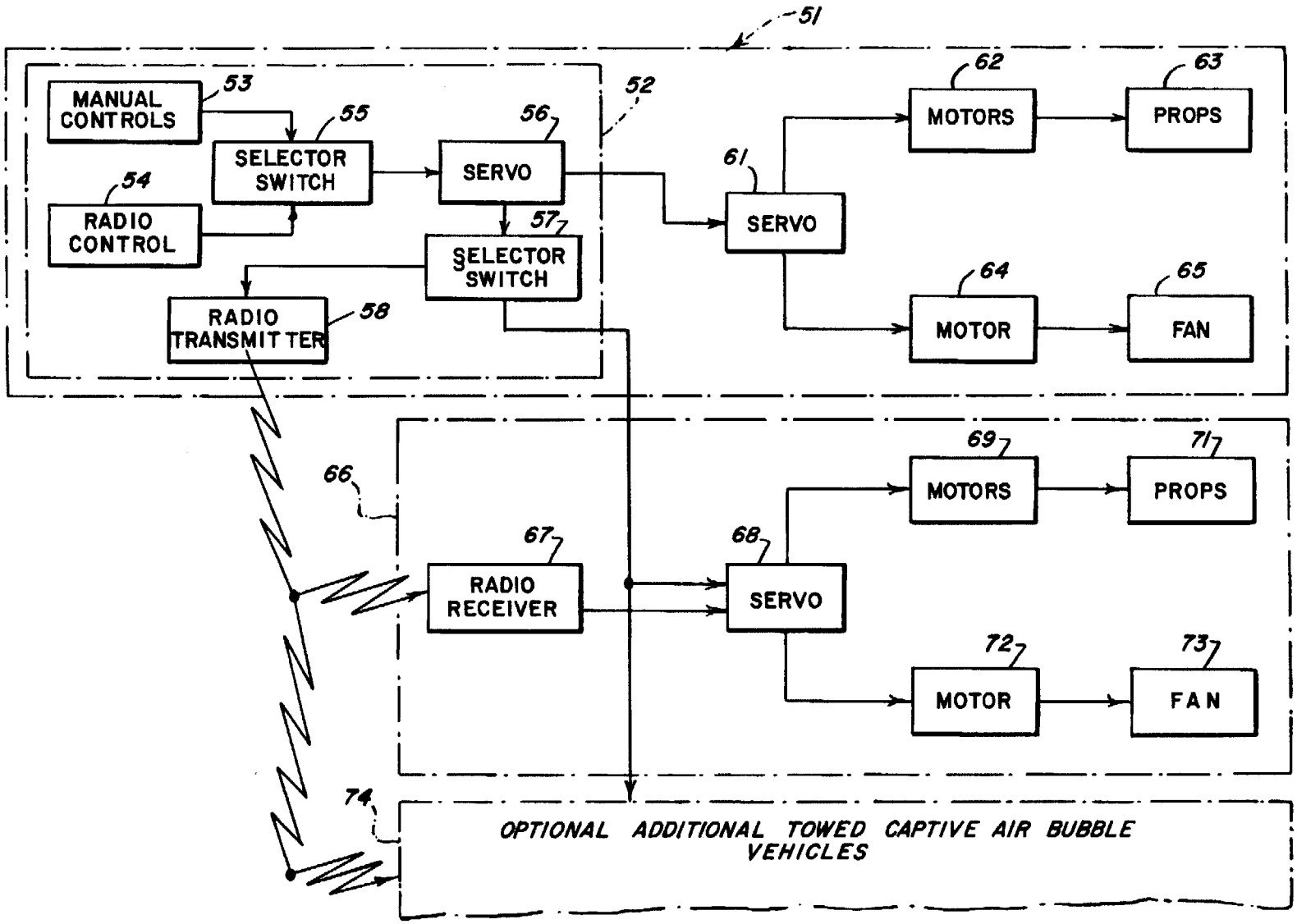
FIG. 4 is a block diagram of one species of the system constituting this invention, wherein each captive air bubble vehicle includes its own power and air supply.

Referring now to the block diagram of FIG. 4 which represents one overall system constituting this invention, it may readily be seen that many of the elements thereof have been previously disclosed either schematically, pictorially, or quasi-pictorially in FIGS. 1, 2, and 3 and, thus, have been discussed to some extent above. Insofar as it is possible, the elements discussed in connection with FIG. 4 will be verbally coorelated with comparable elements of FIGS. 1 and 3; however, in order to maintain a continuity of teaching with respect to the system of FIG. 4, separate and distinct reference numerals will be shown in connection therewith. Accordingly, the system of FIG. 4 discloses a tractor captive air bubble vehicle 51 which may be substantially similar to that shown as captive air bubble vehicle 11 in FIG. 1. Mounted on vehicle 51 is a pilot house 52, which preferably should be so constructed as to accomodate human beings, as well as manual and remote control instruments. In this particular instance, pilot house 52 is shogun as containing manual controls 53 and radio control 54, the outputs of which are connected to the inputs of a selector switch 55. Although selector switch 55 is disclosed merely as such in this figure, it should be understood that it may be so designed as to be operated by either a human operator or a remote control radio or other operator. The output of selector switch 55 is coupled to the input of another selector switch 57. The output of said selector switch 57 is coupled to the input of a radio transmitter 58.

The output of the aforesaid servo 56 is also connected to the input of another servo mechanism 61. Although shown as single blocks, both servo 56 and 61 incorporate such servo mechanisms as are necessary to effect the controlled operations desired, as they were initiated as manual and radio controls 53 and 54, respectively. Therefore, servo 61 has its output connected to rotatable propulsion motors 62 in such manner that rotation thereof and the speed thereof are both regulated as necessary to drive captive air bubble vehicle 51 along a predetermined course through a marine mine field. Of course, actual propulsion thereof occurs as the result of propellers 63 being driven by motors 62.

The aforementioned servo 61 also includes means for regulating the power and speed of motor 64 which is connected to fan 65 so that the proper speed and rotation thereof will be effected and the pressure within the captive air bubble will be maintained at that level which is optimum for any particular operational circumstances. As well as being controlled by command from the pilot house, fan 65 may also be controlled by the depth of captive air bubble needed.

A first towed captive air bubble vehicle 66 is physically connected in tandem behind tractor vehicle 51. In this particular species, first towed captive air bubble 66 is disclosed as receiving its operational signals by cable from selector switch 57 or by electromagnetic energy from radio transmitter 58. In the latter case, a radio receiver 67 is used to supply the control information to a servo mechanism 68, while in the former case, the control cable from selector switch 57 is connected to one of the inputs of servo 68. Servo 68, like servo 61 on vehicle 51, adjusts the rotational disposition, speed, and power of motors 69 and propellers 71 driven thereby. Also, servo 68 adjusts the power and speed of motor 72 which, in turn, drives fan 73.

As many additional captive air bubble vehicles may be towed behind tractor vehicle 51 and/or first towed vehicle 66 as are necessary to simulate any predetermined length of ship. Hence, FIG. 4 illustrates optional additional towed captive air bubble vehicles 74 as being physically connected to the rear end of first towed vehicle 66 and operationally controlled by the outputs of selector switch 57 and radio 58.

Figure 5:
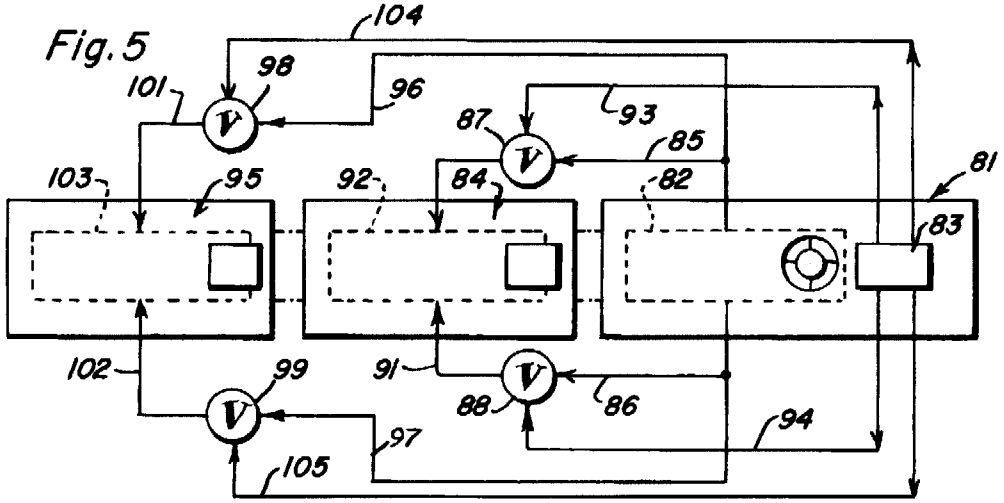
FIG. 5 is a block diagram of another species of the system constituting this invention, wherein there is shown another air supply arrangement for the towed captive air bubble vehicles.

As may readily be seen, the captive air bubble vehicles of FIG. 4 are disclosed as each having their own air supply means incorporated therein. There are, of course, numerous other ways of supplying air to each of the captive air bubble vehicles. Accordingly, another representative species of a suitable air supply system is illustrated in FIG. 5. In this figure, a tractor vehicle 81 is shown as having an air supply and bubble of its own 82 and valve controls 83, as appropriate for controlling its own air supply as well as that of any additional vehicles connected in tandem therewith.

In this particular system a first towed vehicle 84 is connected behind tractor vehicle 81. A flexible piping arrangement including air supply hoses 85 and 86 are connected between the outputs of air supply 82 and the inputs of electrically controlled control valves 87 and 88. The outputs of said control valves 87 and 88 are connected by means of hoses 89 and 91 to bubble chamber 92 of towed vehicle 84. Control valves 87 and 88 are respectively adjusted to be opened and closed as desired by electrical cables 93 and 94 connected between them and the aforesaid valve controls 83.

Again in this particular system, a second towed vehicle 95 which is towed in tandem behind the aforesaid first towed vehicle 84, likewise receives its air supply from tractor vehicle 81. Hence, air supply hoses 96 and 97 are connected between air supply 82 of tractor vehicle 81 and the inputs of control valves 98 and 99. The outputs of these control valves are connected by means of air supply hoses 101 and 102 to air bubble chamber 103 located in second towed vehicle 95. Like valves 87 and 88, control valves 98 and 99 are electrically controlled and are adjusted to open and close positions, respectively, by means of electrical conductors 104 and 105 connected between each of them and the aforementioned valve controls 83 located on vehicle 81.

In this particular instance, control valves 87, 88, 98, and 99, are considered to be electrically controlled control valves; however, they may be pneumatically or otherwise controlled, as is conventional in the control valve art, as long as the valve controls located on tractor vehicle 81 are compatible therewith.

In the system of FIG. 5, two air supplies are shown as being connected between tractor vehicle 81 and each of towed vehicles 84 and 95, but it should be understood that any number thereof which provides the right amount of air to all vehicles (so that an appropriate captive air bubble will be disposed under each thereof) may be incorporated in the subject invention, inasmuch as so doing would be obvious to one skilled in the art having the benefit of the teachings herewith presented.

The operation of the subject invention will now be discussed briefly as follows in conjunction with all of the figures:

A moving depression in the sea surface caused by a moving ship (or other marine vehicle) will generate a flow of water at the sea floor which, in turn, produces a particular pressure pattern or signature thereat. If a marine mine is designed or programmed to detonate in response to a particular pressure signature, it will do so whenever a ship making such a signature passes over it, Hence, it may readily be seen that if such signatures can be simulated by less expensive, less vulnerable, less complex, more expendable vehicles, they can be used advantageously in the sweeping of such mines. The instant invention is just that kind of vehicle.

As tractor vehicle 11 is floated on the water and driven through a marine mine field by means of its propulsion system, blower or fan motor 27 drives propeller 28 in such manner as to draw air from above the vehicle, preferably down through the motor for the cooling thereof, and into the space or chamber bounded by tube 13, membrane 23, and the upper surface of sea water 15. Once the air pressure in said chamber becomes great enough to lift the entire vehicle, it becomes, at least to some extent, an air cushion vehicle of sorts. However, it is perhaps noteworthy that the subject vehicle is different than the air cushion vehicles presently in use, in that it does not ride above the entire sea surface, but, rather, rides at such altitude or level in the water that it also partially floats on tube 13, thereby preventing the air being pumped by fan 28 from escaping around the lower edges thereof. This distinction is of considerable importance, because it causes a captive air bubble to be formed under the vehicle, which may be controlled, as far as dimension, shape, and size are concerned, and, thus, be formed in such manner as to simulate a variety of ship signatures. Of course, it provides the added advantage that it is resiliently resistant to shock waves and air and water pressures caused by an exploding mine, and the vehicle is, therefore, less susceptible to being destroyed or damaged thereby. This, as may readily be seen, increases the life and usefulness of the minesweeper to a considerable extent.

As important as the captive air bubble is, its combination with the aforementioned ballast cells causes the subject minesweeper to be more effective than any known prior art, including an air cushion vehicle used alone. The function of the open-top, resilient-bottom, fluid-filled ballast cell is to absorb all or part of the momentum of the high velocity air and water jet or plume resulting from a mine explosion. Being flexible, membrane 23 ordinarily exists in an unloaded condition until a mine explodes, since the opposing pressures of the water ballast and the air bubble cause it to be maintained in substantially its normal unstressed structural position. But, when a mine explodes, under the impact of the plume jet, a transfer of momentum takes place from the jet to the underside of the membrane, causing it to flex, act as a pressure release, and eject the ballast water through the unrestricted, open cell tops. Thus, the momentum of the explosion is safely absorbed or dissipated by the ejected ballast water, and the minesweeping vehicle can probably be used again to detonate many mines before requiring extensive repairs. Although in this preferred embodiment a resilient membrane bottom is used, it could also be composed of pressure release valves, if so desired.

The ballast also serves the additional function of permitting an increase or decrease in total weight of the minesweeping craft to be effected merely by controlling the amount thereof used at any particular time. This enables a wide range of air bubble pressures to be generated and, thus, a wide variety of ship pressure signatures to be produced.

In the preferred embodiments disclosed herein, the overall ballast compartment is divided into cells 21 having vertical wall dividers, so as to reduce the free surface effect of the ballast water, but it should be understood that under some circumstances this is not necessary.

As previously mentioned, a single tractor type captive air bubble vehicle may be so designed and used by itself to sweep marine mine fields. On the other hand, sweeping may, under some circumstances, be more expeditiously accomplished by employing similar tandem-connected vehicles, the number of which is determined by the length and size of the skip whose signature is being simulated. In addition, depending on operational conditions, the trailing vehicles may be so simplified as to practically be barge types, where they receive their air supply, motive power, and navigation guidance from the tractor vehicle that is towing them. Furthermore, the minesweeper described may also have magnetic and/or acoustic influence elements incorporated therein to act as part of the sweep system in combination with the captive air bubble or alone, as necessary. Being a matter of design choice, it would be well within the purview of the artisan to select the optimum vehicle and sweep element combinations; but, since a swept mine win generally explode near the aft end of a minesweeper, the most expendable type of captive air bubble vehicles should ordinarily be disposed in that position.

Depending upon the type of mines to be swept and the degree of hazzard of sweeping them, the types of motive power, air supply means, and steering system may be selected from those illustrated in FIGS. 4 and 5, as desired. Of course, any other conventional types may be selected, too, without violating the spirit and scope of thus invention.

Incidentally, the tractor captive air bubble vehicle and/or any of its trailing vehicles may be equipped with depressor devices, hydrodynamic or otherwise, to permit the development of air bubble pressures greater than those which would normally exist by reason of the weight of the vehicles alone.

From the foregoing, it may readily be seen that the subject minesweeper and the inventive concept inherently incorporated therein constitute an improvement over the prior art minesweepers known to date, inasmuch as it produces new and improved results heretofore unattainable therefrom.

At this time, it would appear to be noteworthy (and it should, of course, be understood) that all of the individual elements and components included in this invention, including those depicted in block form in FIGS. 4 and 5, are well known and conventional per se, and that it is their new interconnections, new interactions, and new combinations that result in patentable structural embodiments and concepts and produce the new and useful results stated in the objects presented above.

Obviously, other modifications and embodiments of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. Means for simulating a ship's submarine pressure signature comprising in combination:

buoyant vehicle means having a resilient pressure release underside adapted for floating on sea water;

means mounted on said buoyant vehicle means for effecting the support thereof on an air bubble of predetermined pressure that is maintained substantially captive by the resilient pressure release underside thereof and the upper surface of said sea water;

open ended ballast cell means mounted on the upper side of the aforesaid resilient pressure release underside of said buoyant vehicle means in such manner as to effect the closing of the lower open ends thereof;

a predetermined quantity of fluid ballast disposed in said ballast cell means; and means mounted on said buoyant vehicle means for the driving and steering thereof along a predetermined course.

2. The invention according to claim 1 further characterized by means mounted on said buoyant vehicle means for regulating the pressure within the aforesaid captive air bubble.

3. A marine minesweeper comprising in combination:

a chassis means having a predetermined geometrical configuration;

a resilient downwardly extending float means attached to the entire periphery of said chassis means on the underside thereof in such manner as to form an open ended chamber therewithin;

a plurality of open-ended cells mounted on said chassis means in such manner that a like plurality of vertical passageways extends therethrough;

a resilient pressure release membrane attached to the inner periphery of said resilient downwardly extending float means in such manner as to close the upper end of said open-ended chamber and connected to the lower extremities of said plurality of open-ended cells for the closure of the bottom ends thereof, respectively;

a pair of apertures disposed in said chassis means and resilient membrane;

means mounted on said chassis means for blowing air at a predetermined pressure from the upper side thereof through said chassis means and resilient membrane apertures into the open ended chamber formed within the aforesaid resilient downwardly extending float means; and means mounted on said chassis means for the driving and steering thereof along a predetermined navigational course.

4. The device of claim 3 wherein said chassis means comprises:

a bed; and bracing means connected to said bed in such manner as to maintain the geometrical configuration thereof within predetermined flexible limits.

5. The device of claim 3 wherein said resilient downwardly extending float means attached to the entire periphery of said chassis means on the under side thereof in such manner as to form an open ended chamber therein comprises:

a large inflatable rubber tube;

a predetermined plurality of relatively smaller inflatable rubber tubes disposed within the aforesaid large inflatable rubber tube; and air disposed within each of the aforesaid inflatable rubber tubes at such pressure as to make them acquire predetermined geometrical configurations, respectively.

6. The device of claim 3 wherein said plurality of open ended cells mounted on said chassis means in such manner that a like plurality of vertical passageways extends therethrough comprises a predetermined plurality of rigid metallic interconnected side walls.

7. The device of claim 3 wherein said resilient pressure release membrane attached to the inner periphery of said resilient downwardly extending float means in such manner as to close the upper end of said open-ended chamber and the lower extremities of said plurality of open ended cells for the closure of the bottom ends thereof comprises a rubberized fabric sheet having a predetermined thickness and resiliency.

8. The device of claim 3 wherein said means mounted on said chassis means for blowing air at a predetermined pressure from the upper side thereof through said chassis means and resilient member apertures into the open ended chamber formed within the aforesaid resilient downwardly extending float means comprises:

a motor means having substantially vertical air passageways therethrough for the cooling thereof and a rotatable drive shaft mounted in a vertical position; and a propeller connected to the drive shaft of said motor means for being rotatably driven thereby.

9. Means for generating a predetermined pressure pattern within sea water and on the sea floor comprising in combination:

a predetermined plurality of tandem-connected inflatable means adapted for floating on sea water;

a predetermined fluid disposed at a given pressure in each of said predetermined plurality of tandem-connected inflatable means;

means mounted on one of said predetermined plurality of tandem-connected inflatable means for supplying air at such pressure to the underside thereof as to form a captive air bubble between the underside bounded by substantially the periphery thereof and the upper surface of said sea water;

means connected between said one inflatable means and the other inflatable means of said predetermined plurality of tandem-connected inflatable means for supplying air at such pressure to the underside of each of the latter as to form a captive air bubble between the underside bounded by substantially the periphery thereof and the upper surface of said sea water;

a predetermined plurality of ballast cells having side walls, resilient bottoms, and an open upper end mounted on each of said resilient inflatable means in such manner that the resilient bottoms thereof are effectively in contact with the air of each of said captive air bubbles for movement by the pressure thereof, respectively;

a predetermined quantity of water disposed in each of the aforesaid predetermined plurality of ballast cells; and means connected to at least one of said predetermined plurality of tandem-connected inflatable means for the driving and guiding of the aforesaid predetermined plurality of tandem-connected inflatable means along a given navigational course through said sea water.

10. The device of claim 9 wherein said predetermined plurality of tandem-connected inflatable vehicle means adapted for floating on sea water comprises:

at least one tractor captive air bubble vehicle; and at least one trailer captive air bubble vehicle connected in such proximity to the aft end of said at least one tractor captive air bubble vehicle that the overall water pressure signature effected by the combined lengths thereof contains substantially no discontinuity from one end thereof to the other.

11. The device of claim 9 wherein said means connected between said one inflatable vehicle means and the other inflatable vehicle means of said predetermined plurality of tandem-connected inflatable vehicle means for supplying air at such pressure to the underside of each of the latter as to form a captive air bubble between the underside bounded by substantially the periphery thereof and the upper surface of said sea water comprises:

a plurality of flexible hoses connected between said one inflatable vehicle means and each of the other inflatable vehicle means;

a plurality of control valves, each of which is respectively disposed in each hose of the aforesaid plurality of flexible hoses, for regulating the air flowing therein; and means mounted on said one inflatable vehicle means and connected to each of said plurality of control valves for regulation of the air flow therethrough.

* * * * *